US012644671B2

(12) United States Patent
Backhaus et al.

(10) Patent No.: US 12,644,671 B2
(45) Date of Patent: Jun. 2, 2026

(54) SIGHTING DEVICE AND METHOD FOR SETTING A SIGHTING DEVICE

(71) Applicant: Carl Zeiss AG, Oberkochen (DE)

(72) Inventors: Carsten Backhaus, Aalen (DE); Constantin Klug, Baden-Baden (DE)

(73) Assignee: Carl Zeiss AG, Oberkochen (DE)

( * ) Notice: Subject to any disclaimer, the term of this patent is extended or adjusted under 35 U.S.C. 154(b) by 0 days.

(21) Appl. No.: 18/920,956

(22) Filed: Oct. 20, 2024

(65) Prior Publication Data

US 2025/0130017 A1 Apr. 24, 2025

(30) Foreign Application Priority Data

Oct. 20, 2023 (DE) ..... 10 2023 128 954.3

(51) Int. Cl.
*F41G 1/38* (2006.01)
*F41G 1/54* (2006.01)

(52) U.S. Cl.
CPC ..... *F41G 1/545* (2013.01); *F41G 1/38* (2013.01)

(58) Field of Classification Search
CPC ... F41G 1/545; F41G 1/38; F41G 1/42; F41G 1/473; F41G 1/01; F41G 1/02; F41G 1/10;

(Continued)

(56) References Cited

U.S. PATENT DOCUMENTS 4,531,052 A * 7/1985 Moore ..... G01C 3/22 235/407
5,276,554 A * 1/1994 Nassivera ..... F41G 1/38 359/826

(Continued)

FOREIGN PATENT DOCUMENTS

DE 102004047576 A1 4/2006
DE 102019132858 A1 9/2020
DE 102022107872 A1 10/2022

OTHER PUBLICATIONS

Decision to Grant issued in German Patent Application No. DE 10 2023 128 954.3, dated Nov. 25, 2024, (from which this application claims priority) and English language translation thereof.

(Continued)

*Primary Examiner* — Michael D David

(74) *Attorney, Agent, or Firm* — Ewers IP Law PLLC; Falk Ewers

(57) ABSTRACT

A method for setting a sighting device with a telescopic sight and an attachment device is provided. The attachment device includes a display, a control element, and a non-transitory computer-readable storage medium, and is connected to the telescopic sight such that the display can be observed through the telescopic sight. The method includes displaying a center marking at a center position on the display and activating a first interaction mode, in which the center position of the center marking can be shifted into a new center position by operating at least one control element, displaying a circular marking and activating the second interaction mode, in which the size of the circular marking is changeable by operating at least one control element, and storing display information regarding the new center position and the size of the circular marking in the non-transitory computer-readable storage device.

9 Claims, 9 Drawing Sheets

(58) Field of Classification Search
CPC ..... F41G 1/12; F41G 1/27; F41G 1/32; F41G 1/033; F41G 1/34; F41G 1/44; F41G 1/345; F41G 3/005; G02B 15/14; G02B 23/16; G02B 23/14; G02B 27/36; G02B 23/12; G02B 7/04
USPC ..... 42/132, 145, 144, 111, 141, 131, 119, 42/112; 362/84
See application file for complete search history.

(56) References Cited

U.S. PATENT DOCUMENTS 5,528,847 A * 6/1996 Fisher ..... G02B 23/14 42/122
5,930,934 A * 8/1999 Fisher ..... F41G 1/38 42/122
7,170,692 B2 * 1/2007 Toguchi ..... G02B 7/102 359/698
7,905,046 B2 * 3/2011 Smith, III ..... F41G 3/06 235/404
9,091,507 B2 * 7/2015 Paterson ..... F41G 3/06
9,310,165 B2 * 4/2016 Bell ..... F41G 1/473
9,323,061 B2 * 4/2016 Edwards ..... G02B 27/0172
9,383,166 B2 * 7/2016 Jahromi ..... G02B 23/2407
9,494,787 B1 * 11/2016 Bagwell ..... G02B 3/14
9,689,643 B2 * 6/2017 Farca ..... H04N 7/183
10,054,397 B1 * 8/2018 Reimer ..... F41G 1/473
11,428,503 B1 8/2022 Mauricio et al.
11,927,749 B2 * 3/2024 Grigsby ..... G02B 27/0068
12,078,451 B2 * 9/2024 Campbell ..... F41G 11/003
12,339,097 B2 * 6/2025 Loebig ..... F41G 1/17
12,500,674 B2 * 12/2025 Pisenti ..... H04B 10/70
2003/0082502 A1 * 5/2003 Stender ..... F41G 3/2611 434/23
2005/0271373 A1 * 12/2005 Tomita ..... H04N 23/959 348/E5.045
2009/0091634 A1 * 4/2009 Kennedy ..... H04N 23/20 250/214 AG
2010/0060982 A1 * 3/2010 Thomas ..... G02B 7/10 359/422
2014/0110483 A1 4/2014 Benson
2014/0319215 A1 10/2014 Farca et al.
2016/0356573 A1 12/2016 Berlips et al.
2018/0100721 A1 * 4/2018 Lee ..... H04N 23/23
2019/0014243 A1 * 1/2019 Malone ..... G02B 27/023
2020/0284551 A1 * 9/2020 Brown ..... F41G 1/473
2021/0033817 A1 * 2/2021 Masuki ..... G02B 7/09
2021/0318513 A1 * 10/2021 Cai ..... G01D 5/16
2024/0171708 A1 * 5/2024 Hartmann ..... G06V 40/10

OTHER PUBLICATIONS

"Zeiss 2023 / 2024 Hunting and Precision Shooting Catalog", (2023), pp. 38-43, Carl Zeiss AG, Consumer Products Business Group, https://www.zeiss.com/content/dam/consumer-products/downloads/hunting/brochures/en/brochure-zeiss-hunting-catalogue-en.pdf.
Office Action issued in German Patent Application No. DE 10 2023 128 954.3, dated Jun. 7, 2024, (from which this application claims priority) and English language translation thereof.
Office Action dated May 23, 2024, issued in Austrian counterpart application No. A 50934/2023 and English language translation thereof.
Office Action dated Aug. 1, 2024, issued in Austrian counterpart application A 50934/2023 and English language translation thereof.

* cited by examiner

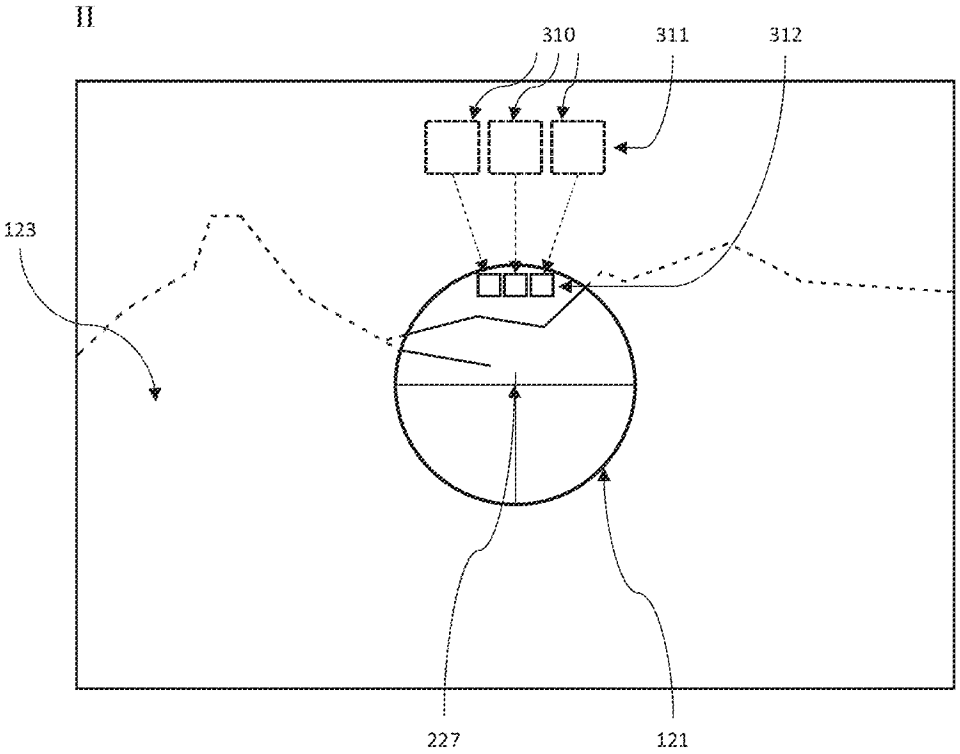
FIG. 6
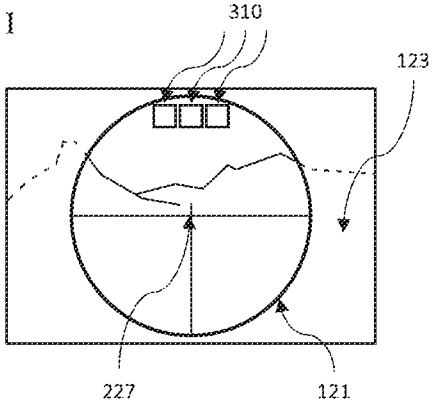

SIGHTING DEVICE AND METHOD FOR SETTING A SIGHTING DEVICE

CROSS REFERENCE TO RELATED APPLICATIONS

This application claims priority to German patent application DE 10 2023 128 954.3, filed Oct. 20, 2023, the entire content of which is incorporated herein by reference.

TECHNICAL FIELD

The disclosure relates to a sighting device having a telescopic sight and an attachment device, and to a method for setting a sighting device.

BACKGROUND

Here and hereinafter, the conjunction "and/or" should be understood to mean in particular that the features linked by this conjunction can be embodied both jointly and as alternatives relative to one another.

A long-range optical device in the sense of the disclosure is a device suitable for displaying an object at a distance of significantly more than one arm's length, typically significantly more than one meter, from an observer to the observer in enlarged fashion in comparison with what the observer would see from the same location without the long-range optical device. For example, such a long-range optical device can originate from the non-exhaustive group of telescopic sights, refractors, telescopes, spotting scopes, binoculars, and cameras with a telephoto lens.

While a particularly well-suited example of a long-range optical device is found in a telescopic sight for hunting or sports used for the purpose according to an aspect of the disclosure, the disclosure can equally also be applied to the use of any other conceivable long-range optical device. The disclosure explicitly includes the use of the features according to an aspect of the disclosure from all embodiments in all conceivable long-range optical devices, even though the disclosure is explained hereinbelow on the basis of telescopic sights for hunting.

Special long-range optical devices, so-called telescopic sights, are frequently used for the accurate use of small arms for hunting or sports. Such telescopic sights are securely mechanically connected to the small arm for hunting or sports such that the user viewing through the telescopic sight gazes in the direction that a projectile moves after a shot has been fired using the small arm.

The term "small arm" includes weapons for hunting, but in particular also all weapons for sports, and other firearms. In particular, this includes rifles, but also other weapons such as automatic and semiautomatic rifles, guns, machine guns and the like.

Long-range optical devices, especially telescopic sights, frequently include an optical construction containing at least two optical groups. In this context, a first optical group is formed by what is known as a telescopic sight objective lens, with which light coming from the object is imaged in a first real image in an objective lens-side image plane. A second optical group, referred to here as telescopic sight eyepiece, serves to allow a user to observe the first real image or a further real image thereof. To this end, the first real image of the object or a further real image thereof is imaged at a large distance, typically at "infinity", by the telescopic sight eyepiece. To this end, the eyepiece is arranged such that the eyepiece-side image plane coincides with, or is at least very close to, the objective lens-side image plane or any other image plane conjugate therewith, such that there is imaging at infinity or in a plane at a large distance.

Telescopic sights very frequently moreover include at least one further optical group, a so-called "erecting system". The erecting system includes at least one optically effective component such as a lens and/or a prism, but a plurality of optically effective components are typical. The erecting system is frequently arranged between telescopic sight objective lens and telescopic sight eyepiece. It serves to image the image in the objective lens-side image plane into a further plane within the telescopic sight, and optically invert said image in the process. Then, the telescopic sight eyepiece is arranged such that it images the image plane of the erecting system at infinity. As a result, the image observed by the user is upright, while it would be "upside down" without erecting system. Telescopic sight objective lens and telescopic sight eyepiece are frequently arranged such that their respective optical axis is arranged on the center axis of a tube, referred to as "outer tube" here.

The optical groups of telescopic sight objective lens and telescopic sight eyepiece are optically characterized, inter alia, by the respective focal length $f_{objective}$ and $f_{eyepiece}$, respectively. For a simple long-range optical device, for example a simple telescopic sight including only these two groups, the optical magnification is then given by $V=f_{objective}/f_{eyepiece}$. Should the long-range optical device moreover include an erecting system with an imaging scale of $\beta_{erecting_system}$, then the overall magnification is given by $V=f_{objective}*|\beta_{erecting_system}|/f_{eyepiece}$.

Telescopic sights frequently include the option of continuously adjusting the optical power of one of the optical groups, whereby a continuous change is achieved in the optical magnification brought about by the telescopic sight. Such optical groups are referred to as a "pancratic" group or as a "zoom" group, or else as a "zoom system" in general. The optical group of the erecting system is frequently in the form of such a zoom group; however, it is also conceivable that this relates to separate optical groups.

Telescopic sights with a changeable magnification are frequently embodied such that the image planes of telescopic sight objective lens and telescopic sight eyepiece have a fixed distance from one another and also maintain said distance when the magnification is changed. In this case, the zoom system is embodied such that the real image from the image plane of the telescopic sight objective lens is imaged in focus into the image plane of the telescopic sight eyepiece, wherein the imaging scale of the image representation can be changed.

Typical ranges for magnifications in the case of telescopic sights for hunting are in the low range, for example in the range from 1.1-times magnification to 8-times magnification, like for example in the case of a ZEISS V8 1.1–8×24 telescopic sight. In the higher range, typical magnifications for example are in the range from 4.8-times magnification to 35-times magnification, like for example in the case of a ZEISS V8 4.8–35×60 telescopic sight. It is self-evident that these magnifications and magnification ranges are only exemplary and should by no means be construed as restrictive. The method according to an aspect of the disclosure can also be applied to telescopic sights with other magnifications and magnification regions.

Telescopic sights frequently include a bearings marker, a so-called reticle. This is a marking, for example crosshairs or a ring. In the optics, a reticle is arranged in a real image plane such that the user can simultaneously observe both the object and the reticle in focus, and the reticle is overlaid on the object. As a rule, the reticle is arranged either in the objective lens-side image plane or in the eyepiece-side image plane. The reticle serves the purpose of allowing the user to aim. Ideally, the reticle is set such that the reticle marks the point of incidence of the projectile when the user gazes through the telescopic sight.

The relative spatial connection between reticle and a real intermediate image can frequently be displaced in two dimensions with the aid of a mechanism; in particular, a displacement in the horizontal direction and, independently thereof, a displacement in the vertical direction are frequently envisaged. This causes the image of the observed object to be displaced relative to the reticle. Reticle and erecting system are frequently attached to an inner tube which is arranged within the outer tube, and which can be displaced and/or tilted relative to the latter. This allows a lateral displacement of a real intermediate image of an object relative to the reticle.

A projectile fired by a weapon for hunting or sports does not follow a straight-line movement; instead, it follows a ballistic trajectory owing to the Earth's gravitational force. The trajectory is moreover modified by other external influences, for example wind. Displacing the real intermediate image of an object relative to the reticle by the user operating the mechanism allows the telescopic sight to be set such that the reticle is overlaid on the image of the point of incidence of the projectile.

Telescopic sights are typically purely optical devices; however, it is also conceivable to form part of the image transfer path electronically. To this end, an image recorder or sensor capable of creating an electronic image representation of the real image can be arranged in the image plane of the objective lens, for example. This electronic image representation can be displayed on a picture generator, an electronic visual display or a display, which is arranged in the image plane of the eyepiece. Image erection, variable magnification and/or overlay of the reticle, in particular, can be carried out electronically in the case of such an arrangement.

The disclosure is therefore expressly not restricted to an application in the case of purely optical long-range optical devices, but also includes the application in those devices that contain an electronic image transfer.

An attachment device in the sense of the disclosure is for example, but not exhaustively, a thermal imaging device or a residual light amplifier or a comparable device, suitable in particular for the observation of poorly visible objects with a modified and/or improved contrast and/or increased brightness. For example, a thermal imaging device can convert different levels of heat from an object into a visible brightness contrast and/or a visible color contrast. This can be achieved by capturing the long wavelength radiation emitted by the object to be observed. In the electromagnetic spectrum, this radiation is frequently in the infrared range not visible to the human eye.

A residual light amplifier at least increases the brightness when observing an object; however, it can also increase and/or modify the contrast. In such a device, at least a portion of the observed light is usually in the range of the electromagnetic spectrum visible to the eye. In terms of its construction, a residual light amplifier in particular, but a different attachment device as well, can fundamentally correspond or at least be similar to a long-range optical device with an electronic image transfer path, as explained above. Therefore, in particular, the disclosure also includes, albeit not exclusively, the use of a combination of two long-range optical devices with an electronic image transfer path.

In the sense of the disclosure, an attachment device includes an "attachment device objective lens", which images the light from a suitable wavelength range onto an electronic image recorder, referred to here as an "attachment device sensor". The attachment device objective lens usually contains one or more optically effective elements, frequently optical lenses. In order to image long-wavelength infrared light, the lenses frequently includes at least predominantly germanium or chalcogenide. The attachment device creates an optical image which can be recorded by the attachment device sensor, frequently but not exclusively of the "bolometer" type. The attachment device sensors utilized frequently contain amorphous silicon and/or vanadium oxide. The attachment device sensor is suitable for creating a first sequence of digital images, which can be processed and modified using a data processing unit. The created, possibly modified images form a second sequence of digital images.

For example, the data processing unit allows the visual contrast to be increased vis-à-vis the first sequence of images. To this end, the data processing unit can execute one or more data processing algorithms in the form of a computer program code. The visibility of details in the recorded image sequence is frequently increased by the data processing performed by the data processing unit. The second sequence of digital images can be created so as to take account of specific color modes in particular. It is possible to use algorithms which contain a type of automatic exposure, in the sense that the individual images are changed in such a way that they are adapted to changing ambient conditions, for example ambient temperature.

The second sequence of digital images is displayed on an electronic picture generator or electronic visual display, referred to here as "attachment device display". The overall brightness of such an attachment device display can frequently be adapted by the user, in particular in order to achieve adaptation to the brightness of the surroundings. An "attachment device eyepiece", with which the image displayed on the attachment device display can be observed by an observer, is arranged in the optical path downstream of the attachment device display. In terms of the optical construction, the "attachment device eyepiece" can correspond to that of a state-of-the-art known eyepiece for visual observation; however, it can typically also correspond to a collimator in terms of optical construction. The term "attachment device eyepiece" is used here purely for better readability; however, it is intended to include all optical groups suitable for bringing light coming from a real image and/or an object into a parallel beam path and/or imaging said light at a large distance. Here and hereinbelow, a "parallel beam path" is understood to mean a beam path in which the light of an object point brought into focus is converted into a parallel or approximately parallel beam of light.

The magnification of an attachment device is frequently at or close to 1-times magnification. As a result, the geometric visual impression given by the observation of an image on the display of the attachment device through the telescopic sight can be made to approximately correspond to the geometric visual impression given by the observation of the same object without the attachment device, since the overall magnification of a sighting device in the sense according to an aspect of the disclosure arises precisely as the product of the magnifications of the attachment device and telescopic sight components.

Since the attachment device is an electronic device, such an attachment device frequently includes displays of, e.g., operational parameters or other indicators. For example, this can be the display of a magnification, a distance, an angle, a levelling display, a charge state of a battery or rechargeable battery, an operating mode, a display profile, a chosen contrast setting, a connectivity display, for example for Bluetooth, and/or similar further information. Such information can be textual information, but also graphically displayed information or else icons. Such information is frequently displayed in an edge region of the attachment device display in order to keep the central region of the attachment device display free for the observation of the objects to be observed.

To control an attachment device, control elements are frequently located on the attachment device, for example one or more control buttons, one or more pushbuttons, one or more switches, one or more control wheels and/or one or more further control elements.

A long-range optical device and an attachment device are frequently similar in terms of the optical construction inasmuch as both include an objective lens suitable for imaging distant objects, objects at a distance of up to "infinity", into an objective lens image plane. Furthermore, both include an eyepiece suitable for imaging an image plane into a virtual image at a large distance, at a distance of up to "infinity".

It is known practice to arrange attachment devices in front of telescopic sights or other long-range optical devices in such a way that they are optically in a row, and the optical axis of the eyepiece of the attachment device and the optical axis of the objective lens of the telescopic sight coincide, or are at least approximately coincident. Then, the parallel exit beam path of the eyepiece of the attachment device and the parallel entrance beam path of the objective lens of the telescopic sight coincide, and the images displayed on the display of the attachment device can be observed by the user via the telescopic sight. Such a combination, referred to as a "sighting device", of telescopic sight and attachment device is known from DE 10 2004 047 576 A1, for example.

For an optimal interplay between attachment device and telescopic sight, it is advantageous for the exit pupil of the eyepiece of the attachment device to coincide with the entrance pupil of the objective lens of the telescopic sight. It was found that the attainable advantages are minimal vignetting, maximal light yield and/or maximal field of view.

For an optimal interplay between attachment device and telescopic sight, it is furthermore advantageous for the magnification of the attachment device to be an approximately 1-time magnification because the magnification of the telescopic sight when the attachment device is used then precisely corresponds to the magnification of the direct view of the object through the telescopic sight without attachment device.

Attachment devices suited to being attached and mechanically fastened in front of a telescopic sight are known. In other words, the long-range optical device looking "at infinity" can be arranged optically in series behind the attachment device eyepiece of the attachment device imaging "at infinity", with the result that the long-range optical device is used to observe the display of the attachment device.

Many long-range optical devices offer the possibility of setting the magnification, which is called "zooming". This is particularly true for many telescopic sights for hunting. Should the telescopic sight be attached optically in series downstream of the attachment device as described above, a differently large area of the attachment device display is observed when the magnification of the telescopic sight is changed; this change depends on the magnification of the telescopic sight. In this case, the following is true: the larger the magnification, the smaller the observable electronic visual display region. For example, if the entire attachment device display is just observable in the case of a 1.1× magnification of the telescopic sight in one configuration, then only a portion of the attachment device display is observable in the case of a 2.2× magnification. In the case of a 4.4× magnification, only a portion of the attachment device display half the size of that in the case of a 2.2-times magnification is still observable. In other words, twice the magnification leads to an image portion with half the width and half the height, i.e., a quarter of the area, being observable. In detail, other observable portions of the attachment device display arise for other configurations and magnifications, with the fundamental principle however being equivalent.

Since the attachment device and the telescopic sight or other long-range optical device are optically coupled with an at least approximately parallel beam path, the focusing of the long-range optical device is maintained when zooming, and all that changes is the observable portion of the attachment device display, as described above. Since a smaller part of the attachment device display is imaged when a larger magnification of the telescopic sight is chosen, this appears to an observer as if an image portion with a tighter angle is observed using the entire observation device. Thus, the effect of zooming is identical to the effect of zooming without an attachment device: the larger the magnification, the smaller the observed region and the larger the representation of the observed region.

Should the mechanical attachment of the attachment device to the telescopic sight be not absolutely precise, the optical axis of the telescopic sight and the optical axis of the eyepiece of the attachment device can differ from one another, and the center of the display is not observed on the optical axis of the long-range optical device. It is also possible that the center of the display is not located on the optical axis of the eyepiece, for example on account of manufacturing tolerances. In this case, the center of the display is regularly not observed on the optical axis of the telescopic sight. It is likewise possible that the center of the attachment device sensor is not located on the optical axis of the attachment device objective lens. As a result, the optical axes of the telescopic sight and of the attachment device objective lens might deviate from one another. In all of these cases, there is a displacement of the observed scene with an attachment device in comparison with the observation without an attachment device.

Thus, a respective different region of the attachment device display is observable, depending on the magnification and the adjustment. As a consequence, certain information, for example but not exhaustively at least one of the group of an icon, symbol, status display and/or system parameter, might be displayed on the electronic visual display but the user cannot observe it since the portion of the electronic visual display observable through the telescopic sight is too small and/or located at the wrong position. In other words, this might give rise to the situation that the displayed information is located outside of the currently observable portion of the attachment device display. This problem occurs particularly frequently for information such as icons, status displays, menu options and/or one or more similar pieces of information, since such information is frequently intended to be displayed in a peripheral zone of the field of view of the telescopic sight.

Known systems, for example the one described in DE 10 2004 047 576 A1, provide no solution for the rectification of these disadvantages.

SUMMARY

It is therefore an object of the disclosure to provide a method with which the described disadvantage is avoided by virtue of allowing the attachment device to be set in such a way that a permanent observation of such information is ensured, independently of the magnification setting of the telescopic sight.

The object is achieved by a method for setting a piece of sighting equipment as described herein.

Another object of the disclosure is that of providing a piece of equipment in which the described disadvantage is avoided, specifically that information displayed on the electronic visual display of the attachment device is not observable through the telescopic sight because it is located outside of the observable portion of the electronic visual display.

This object is achieved by and the sighting device as described herein

On account of the rotationally symmetric construction of optical systems conventional in long-range optics and also applicable to conventional telescopic sights, the assumption is made below that a circular field of view is observed using a long-range optical device, in particular a telescopic sight. The explanation of the disclosure and the exemplary embodiments therefore relate to optical units having a rotationally symmetric arrangement and a circular field of view. However, the disclosure can also be transferred accordingly to any other form of optical observation device, for example to long-range optical devices with a rectangular or oval field of view. The solution according to an aspect of the disclosure therefore includes other such geometries.

A "circular marking" in the sense of the disclosure represents a plurality of display elements which are displayed on an electronic visual display, in particular an "attachment device display", and suitable for allowing a user to identify an at least largely circular structure "all around" a center. In other words, the structure arranged all-around encloses this center. For example, the circular structure can be a solid circle, a circle portion, a regularly or irregularly dashed circle, a regularly or irregularly dotted circle consisting of at least three points. Instead of the points, other small display structures made of any shape are also conceivable. Any shown arrangement of arbitrarily shaped display structures arranged substantially around a center, typically in rotationally symmetric fashion, and/or any other geometric arrangement of display structures suitable for allowing an observer to identify an underlying circular arrangement or a circular boundary is suitable in principle. The individual display structures can differ from one another. They can also be icons, symbols, letters, characters, numbers, and/or menu elements. An analogous arrangement of the display structures can also be found for other target geometries to circular geometries.

Such a circular marking can be displayed at a predefined position on an attachment device display. In this case, the circular marking includes a center, corresponding to the center of the circle to be indicated or displayed, and a display size, corresponding to the radius of the circle to be indicated or displayed. The display of a such circular markings represents an auxiliary means during the setup within the method according to an aspect of the disclosure. In other words, the circle indicated or displayed by such a circular marking runs all around a center. It is self-evident in this case that this center need not necessarily be located within a polygon formed by the individual display elements of the circular marking; instead, it is completely sufficient for the center to be located within the circle to be indicated or displayed itself. For example, the center of a circle indicated by a dotted third of a circle is not located within the "cake slice-shaped" polygon formed by the points of such a circular marking. Nevertheless, an observer can undoubtedly identify the indicated circle by such an arrangement of individual display elements on a third of a circle.

At least three displayed display structures are typical, and more than three displayed display structures are particularly typical, for the case where the circular arrangement is not observed in centered fashion by way of the telescopic sight or where such a centered observation at least cannot be assumed. At least one single displayed display structure is sufficient to uniquely define the circle in the case where a centered observation of the circular arrangement by way of the telescopic sight can be ensured. Typically, the center marking is additionally also displayed in this case. However, it is likewise typical for more than one display structure of the circular marking to be displayed in this case, too; it is particularly typical for three or more display structures of the circular marking to be displayed.

To perform the adjustment method according to an aspect of the disclosure, the telescopic sight should initially be in, or at least near, the setting with the lowest magnification, in order to allow an observation of an image portion of the attachment device display that is as large as possible. The adjustment method is activated by the user, for example by pressing a pushbutton, control button, switch or the like, or by selecting a menu option, on the attachment device. This starts the method according to an aspect of the disclosure.

In a first step according to an aspect of the disclosure, the attachment device can display a center marking on the attachment device display. Any electronic-visual-display display suitable for marking a position, referred to here as "center position", on an electronic visual display such that the position and/or its immediate surroundings is rendered identifiable by an observer of the electronic visual display is possible as such a center marking. For example, this can be a pixel or a few pixels in proximity of one another, a circle with typically a small radius, a cross, a star and/or any other geometric figure suitable for prominently singling out a position on an electronic visual display. According to an aspect of the disclosure, the attachment device switches into a first interaction mode as part of the first step, in such a way that the operation of one or more specific control elements on the attachment device leads to a shift of the center marking in one or two dimensions as a consequence, whereby different positions are singled out on the attachment device display in each case. In this context, there can typically be a shift in the horizontal direction and/or typically a shift in the vertical direction, with shifts in all other directions naturally also being included according to an aspect of the disclosure. A suitable control element is typically one from the group of control buttons, pushbuttons, switches, rotary wheels, joysticks and/or touchpads; however, all other conceivable control elements, for example voice recognition, are also included. The disclosure also includes control elements being embodied such that they are displayed and/or controllable with a program and/or an "app" on a mobile digital terminal, for example a cellular telephone, a tablet, a laptop, a remote control or similar device, and the interaction commands are transferred to the attachment device display from the mobile digital terminal via an interface, for example a cable, Bluetooth, WLAN or a similar data transfer option.

In other words, controlling control elements on the attachment device itself or on a digital terminal with a subsequent transfer of the information to the attachment device should generally be considered equivalent; in this text, this should be meant in overarching manner by the control of control elements.

The shift of the center marking in the first interaction mode can be enabled in two dimensions, typically in the horizontal and vertical directions. In other words, a shift can optionally be carried out independently in two dimensions. However, a subdivision into two phases is also conceivable, wherein a shift in one dimension is possible in the first phase and a shift in a different dimension is possible in a second phase. It is also possible that the two phases are run through multiple times in succession in order to enable an even more precise setting. The individual phases or else the first interaction mode can be terminated by a control element of the aforementioned type. According to an aspect of the disclosure, the first interaction mode can also be terminated automatically by virtue of this mode being terminated independently by the attachment device after a certain period of time without user interaction. Typically, the length of this period of time is adjustable by the user in the configuration of the attachment device.

In any case termination of the first interaction mode leads according to an aspect of the disclosure to the storage of position information regarding the new position of the center marking, i.e., the new center position, in a non-transitory memory. The first step according to an aspect of the disclosure finishes after the position information was stored.

The described first step according to an aspect of the disclosure allows the user of the attachment device to bring the center position of the center marking and the reticle of the telescopic sight attached to the attachment device into optical overlap. The position information regarding the center position of the center marking obtained thus can be used to allow a display of information on the attachment device display in a manner centered with the view through the telescopic sight. To this end, the most recent center position can be stored in a transitory or non-transitory memory in the attachment device.

In a second step according to an aspect of the disclosure, the attachment device displays a circular marking of the above-described type, in such a way that the latter is arranged all around the most recent center position of the center marking. For example, the circular marking can be centered around the center position by virtue of the display structures of the circular marking having substantially the same distance from the center position of the center marking. In the case where the circular marking is indicated by only a single display structure, the distance of the display structure from the center position of the center marking corresponds to the radius of the circular marking which is arranged all around the center position with the radius of the distance between the center marking and the single display structure. Typically, the initial selection of the circular marking can be so large that it can be identified easily by the observer. The center marking from the first step can remain superimposed but can optionally also be masked. According to an aspect of the disclosure, the attachment device switches into a second interaction mode, in such a way that the operation of one or more control elements leads to a change in the size of the circular marking. In other words, the operation of one or more control elements on the attachment device leads to a change in the distance of the display structures of the circular marking from the center position of the center marking. Typically, the size is changed equally in two dimensions in the process. Mathematically, this corresponds to a homothety, wherein the center position of the center marking is typical as the center of said homothety. However, a change in only one dimension is also included according to an aspect of the disclosure; this leads to deformation of the circular marking. For example, the circular marking can be deformed linearly in one dimension to form an elliptical shape. During the change in size, the display structures and/or lines of the circular marking can typically retain their own symbol size and/or their line thickness; however, it is also conceivable that their symbol size and/or their line thickness scales as well.

A suitable control element is typically one from the group of buttons, pushbuttons, switches, rotary wheels, joysticks and/or touchpads; however, other control elements, for example voice recognition, are also included.

The disclosure includes an increase in size of the circular marking being brought about by one control element and a reduction in size of the circular marking being brought about by another control element. The disclosure also includes different ways of controlling one control element optionally bringing about an increase or decrease in size of the circular marking. Examples in this respect can be pushing a pushbutton once or twice, or else a short or long push of a pushbutton. The disclosure also includes multiple operations of a single control element bringing about multiple step-by-step changes in size of the circular marking in one direction, up to an extremal value. Once the extremal value has been reached, a further operation of the control element can bring about a discontinuous one-time change in size in the other direction. In other words, this type of control brings about step-by-step, cyclical switching through the size of the circular marking through a given number of size levels. For example, a change in the switching-through direction can be brought about by a long-lasting operation of a control element. All of these described control concepts are purely exemplary and should not be construed as limiting. Other—in part similar—control concepts which lead to the same result are conceivable, and these should likewise be included according to the disclosure.

The second interaction mode can be terminated by operating a control element of the aforementioned type. According to an aspect of the disclosure, the second interaction mode can also be terminated automatically by virtue of this mode being terminated independently by the device after a certain period of time without user interaction. Typically, this period of time is adjustable by the user in the configuration of the attachment device.

The termination of the second interaction mode in any case leads to the size information that was obtained being stored in a non-transitory computer-readable storage medium. The display of the attachment device display can already be adapted in accordance with the stored display information, specifically position information and size information, at this point.

The described second step according to an aspect of the disclosure allows the user of the attachment device to precisely set the size of the circular marking such that it is just still visible for a magnification level of the telescopic sight connected to the attachment device that was set previously by said user. The size information regarding the size of the circular marking obtained in this way correlates directly with the size of the region of the display observable through the telescopic sight. This can be used to overlay overlays, for example icons at positions within the area of the circular marking, such that these are identifiable during the normal operation of the attachment device for the chosen magnification of the telescopic sight.

The first step according to an aspect of the disclosure and/or the second step according to an aspect of the disclosure can be optionally followed by a third step, in which the attachment device switches into an interaction mode that allows the parameters obtained, the center position of the center marking and the size of the circular marking, to be stored in a non-transitory computer-readable storage medium. This can ensure that the obtained display information made up of position information and size information is available again during the subsequent use of the attachment device. In an exemplary embodiment, it might only be these values that are stored in the non-transitory computer-readable storage medium. The display of the attachment device display can typically be adapted directly in this case. In a more complex, particularly typical exemplary embodiment, the values can be stored in one of several "profile memory locations" in the non-transitory computer-readable storage medium. In this case, it is possible that the display information can be stored in the non-transitory memory as a "profile" at an assigned profile memory location next to other similar pieces of display information from other "profiles" in other accordingly assigned profile memory locations, with the result that the user is given the option of storing position information regarding center positions and size information for a plurality of magnification levels of the telescopic sight and/or for a plurality of telescopic sights, and of retrieving this information again at a later time.

In this context, at least three pieces of numerical information are typically stored per profile memory location. For example, these can include a horizontal and a vertical coordinate of the center position of the center marking as position information and a radius of a circle-shaped circular marking as size information. Naturally, it is conceivable to store any other equivalent numerical information that contains substantially the same information or complements the latter. In other words, the disclosure should include all combinations of numerical data from which the required parameters can be derived by mathematical operations.

The display information can typically be stored in so-called flash memories as a non-transitory computer-readable medium. This can be a storage medium securely integrated in the attachment device; however, it is also conceivable that the storage medium is interchangeable, for example in the form of an SD card or USB stick or comparable medium. It is likewise conceivable that the display information is stored on an external medium, for example a cellular telephone, and can be retrieved by the attachment device when required by way of a suitable wired interface, for example but not exhaustively USB or Thunderbolt, or by way of a wireless interface, for example but not exhaustively using Bluetooth or WLAN.

According to an aspect of the disclosure, a telescopic sight can be equipped with a sensor, referred to here as "zoom sensor", which converts the magnification set by the user into an electrical or digital or similar signal. For example, the zoom sensor can include a potentiometer or a rotary encoder or similar component. The zoom sensor might contain a controller suitable for converting the physical measurement value into digital or similar information. The latter, which is created by the zoom sensor and referred to here as zoom information, can be transferred to the attachment device via an interface. This can be realized by electrical contacting, for example a plug-socket combination or pin-contacting in the region of the mechanical interface between telescopic sight and attachment device. A wireless data transfer, for example but not exhaustively via Bluetooth or WLAN, constitutes another option for data transfer. To this end, the telescopic sight can be equipped with a radio unit, a transmitter, and the attachment device can be equipped with a further radio unit, a receiver. Equipping both telescopic sight and attachment device with a respective radio unit capable of both transmitting and receiving is also conceivable and typical.

Depending on the zoom information regarding the zoom setting transmitted from the telescopic sight to the attachment device, the attachment device can according to an aspect of the disclosure choose a suitable profile and set the display of the attachment device accordingly. For example, in the case of a zoom setting for 3-times magnification, it is possible to choose a profile which is attuned at least approximately to twice the size of the displayed area of the attachment device display in comparison with the setting of the telescopic sight for 6-times magnification. In other words, this example sees the selection of a profile in which the previously determined radius of the circular marking for 3-times magnification of the telescopic sight is at least approximately twice as large as the radius of the circular marking of the best-fitting profile for 6-times magnification.

When adjusting the magnification, the currently set magnification of the telescopic sight, as ascertained by the zoom sensor, can be transmitted to the attachment device via the data interface provided. A computing unit within the attachment device can subsequently compare the set magnification with the stored profiles. If one of the profiles stored at a profile memory location fits to the set magnification, then this profile can be selected, and the display of the attachment device display can be set accordingly, with the result that information and/or icons possibly intended for display are displayed in the region of the attachment device display observable by the telescopic sight at the set magnification.

Alternatively, a mathematical correlation can be created from at least two stored profiles, each containing a magnification of the telescopic sight, by executing an algorithm in the attachment device. This correlation can be, for example but not exhaustively, a linear or quadratic function or any other polynomial. Using this correlation the attachment device can quasi-continuously determine an ideal size of a circular marking for any desired magnification level of the telescopic sight and set the size of the utilized display accordingly, in such a way that information and/or icons and/or similar information to be displayed is always located within the region observable by the telescopic sight.

As an alternative or in addition, profile memory locations in the non-transitory computer-readable storage medium can, in a further exemplary embodiment, be preoccupied with display information corresponding to known magnifications of known telescopic sights. Such information can also be transmitted from a mobile terminal to the attachment device, typically by wireless communication, and hence preoccupy one or more profile memory locations with display information.

BRIEF DESCRIPTION OF THE DRAWINGS

The disclosure will now be described with reference to the drawings wherein:

FIG. 6 shows examples of different observed fields of view through different magnifications of the telescopic sight.

DESCRIPTION OF EXEMPLARY EMBODIMENTS

Figure 1:
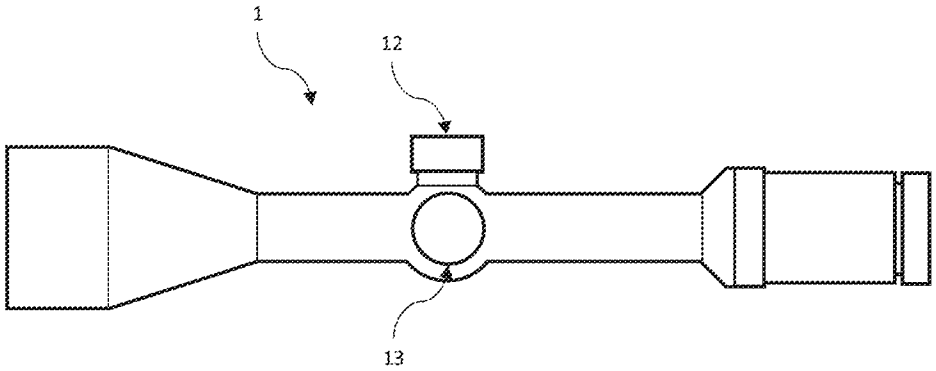
FIG. 1 shows a telescopic sight in a side view.

FIG. 1 shows an exemplary side view of a telescopic sight 1. The telescopic sight includes one or more rotatable adjustment knobs, for example a reticle adjustment 12 and/or a focus adjustment 13. The focus adjustment is frequently referred to as "parallax compensation". The focus adjustment moves a focusing lens 15. See FIGS. 3A, 3B, and 5A to 5C.

Figure 2:
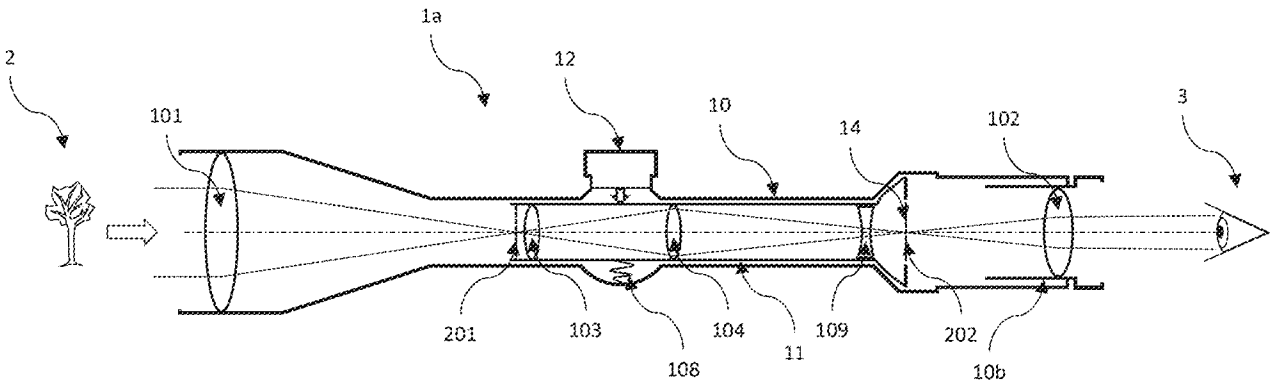
FIG. 2 shows a cross section through a telescopic sight with fixed magnification.

FIG. 2 shows an exemplary cross section through a telescopic sight with a fixed magnification 1*a*. An optical assembly called "telescopic sight objective lens" 101 is arranged in the "objective lens-side" part of the telescopic sight 1*a* which faces the object 2 to be observed. This optical assembly might include a single lens; however, two or more than two optical lenses and/or other optically effective elements are typically contained. A further optical assembly called "telescopic sight eyepiece" 102 is arranged on the opposite side of the telescopic sight 1*a* that faces away from the object. This optical assembly might include a single lens; however, two or more than two optical lenses or other optically effective elements are typically contained.

The optical assemblies of telescopic sight objective lens 101 and telescopic sight eyepiece 102 are arranged in series in such a way that their optical axes are arranged at least approximately parallel to one another; the optical axes ideally coincide. The assemblies are held by a structure referred to here as "outer tube" 10. This outer tube 10 might have the shape of a rotationally symmetric tube, but this is not mandatory. In other words, a rotationally symmetric tube is a tube with a circular cross section. The outer tube 10 can be constructed in one or more pieces. The telescopic sight eyepiece 102 optical assembly in particular is frequently housed in a separate tube portion 10*b*, which can be attached with correctly aligned axis to another portion of the outer tube 10. This separate tube portion 10*b* can be embodied to be displaceable for the purpose of setting diopters along the optical axis. The separate tube portion 10*b* is frequently arranged at least partially within the outer tube 10.

An erecting system 104, including at least one optical lens but typically include more than one optical lens or other optically effective components, is frequently attached between telescopic sight objective lens 101 and telescopic sight eyepiece 102. The erecting system 104 is frequently attached within an inner tube 11 which can be tilted and/or shifted relative to the outer tube 10 with the aid of the reticle adjustment 12. This is counteracted by the spring 108 with a restoring effect. The reticle 14 is frequently likewise attached within the inner tube. Moreover, the inner tube can contain further optical elements, for example one or more field lenses 103 and/or one or more Barlow lenses 109.

The light coming from a faraway object 2 ("at infinity") forms an approximately parallel beam path. The telescopic sight objective lens 101 images this light into a first image plane 201 of the telescopic sight objective lens 101. The erecting system 104 images the image from the first image plane 201 of the telescopic sight objective lens 101 into a second image plane 202 of the telescopic sight eyepiece 102. The reticle 14 is frequently and typically arranged in this image plane; however, it can also be arranged in any other plane optically conjugate thereto. Through the telescopic sight eyepiece 102, the observer 3 observes an image in the second image plane 202, which is imaged by the telescopic sight eyepiece 102 into a faraway plane, at "infinity". In other words, the telescopic sight eyepiece 102 creates a largely parallel beam path, which can be observed by the observer 3 with a relaxed eye.

Figure 3A:
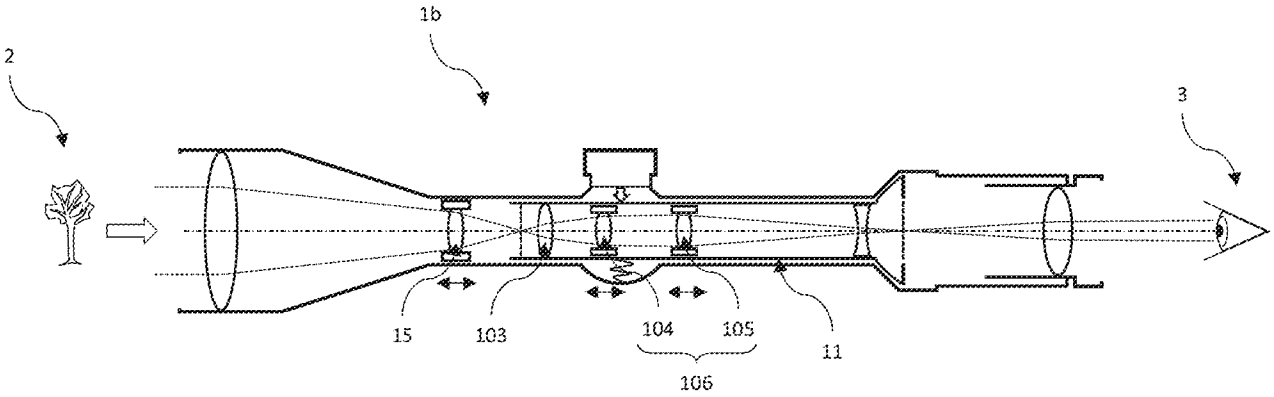
FIG. 3A shows a cross section through a telescopic sight with variable magnification in a first zoom setting.
Figure 3B:
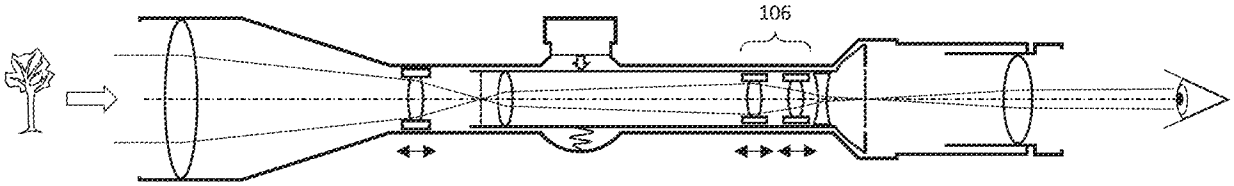
FIG. 3B shows a cross section through a telescopic sight with variable magnification in a second zoom setting.

FIGS. 3A and 3B show a further exemplary cross section through a telescopic sight 1*b* with variable magnification. The basic construction corresponds to that of the telescopic sight 1*a* of FIG. 2; however, in this case the lens group of the erecting system 104 is configured to be displaceable within the inner tube 11, and a further displaceable lens group of the erecting system 105 is additionally provided. Together they form both an erecting system and a zoom system 106. FIG. 3A shows a first position of the combined erecting and zoom system 106; FIG. 3B shows a second position. The individual lenses of the zoom system 106 can travel different paths during zooming and can also be shifted counter to one another.

Figure 4:
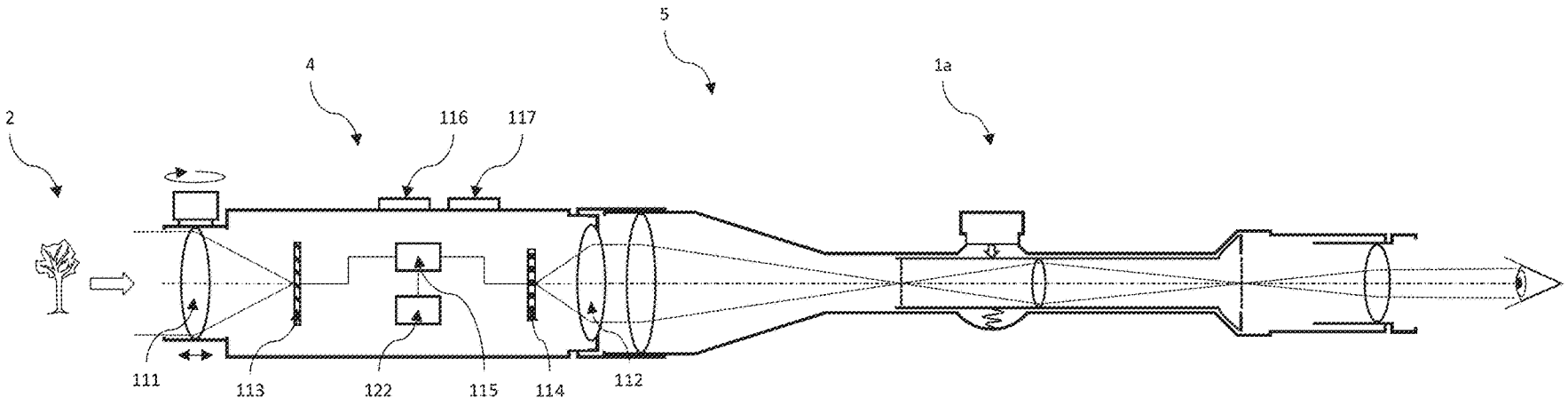
FIG. 4 shows a cross section through a sighting device including an attachment device and a telescopic sight.

FIG. 4 shows an exemplary cross section through a sighting device 5 including a telescopic sight 1*a* and an attachment device 4 attached thereto. The attachment device contains an attachment device objective lens 111 suitable for imaging light from a faraway object 2 on an attachment device sensor 113. The light imaged by the attachment device objective lens 111 and detected by the attachment device sensor 113 can be visible light; however, it can also be light invisible to the human eye. Such devices are frequently equipped such that light in the infrared spectral range is imaged. In that case, use is optionally made of optical components, for example lenses, which have a high transparency in the required spectral range. For example, optical components made of germanium are frequently used for infrared light. It is self-evident that the attachment device sensor must likewise be adapted to the spectral range of interest. An image that has arisen on the attachment device sensor 113 is converted into a data record which can be processed and modified in a data processing unit 115. For example, contrast can be increased and/or image colors can be changed by calculation in this case. The data record modified thus is displayed on an attachment device display 114 from which light in the visible spectral range is emitted. The attachment device display 114 can be observed by way of an attachment device eyepiece 112. The attachment device eyepiece 112 is equipped such that it has high transparency in the visible spectral range of light. The attachment device eyepiece images an optical plane of the attachment device display into a very faraway virtual plane, at "infinity", whereby a so-called parallel beam path is created optically. Since a telescopic sight 1*a* coupled to the attachment device 4 is in turn able to allow the observation of a faraway object 2, or of an object "at infinity", this being implemented via light in a likewise parallel beam path between the object 2 and telescopic sight 1*a*, the telescopic sight 1*a* is also able to allow the observation of the parallel beam path created by the attachment device 4.

The attachment device 4 may contain one or more control elements 116, 117. A control element 116, 117 can be an element from the following set: a pushbutton, a control button, a switch, a touch-sensitive element, a rotary wheel, a rotary wheel with integrated button function, a joystick, a microphone, a light-sensitive sensor, a light-sensitive sensor with coupled illumination. According to the disclosure, a control element can also be a different element to one of those listed. All that matters is that the element enables an interaction of a user with the data processing unit 115. According to an aspect of the disclosure, the attachment device may contain a plurality of similar control elements but also different control elements. An interaction by a user, for example pushing a pushbutton or turning a rotary wheel or the like, creates a signal for the data processing unit 115, which can serve to control the attachment device 4, in particular also to perform the method according to an aspect of the disclosure.

Figure 5A:
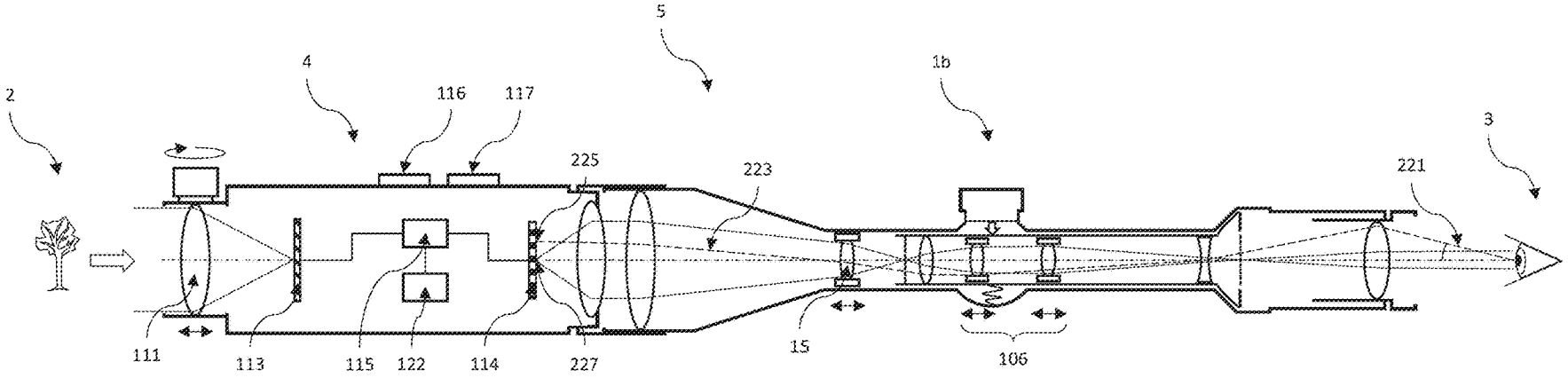
FIG. 5A shows a cross section through a sighting device including an attachment device and a telescopic sight with variable magnification in a first zoom setting.
Figure 5B:
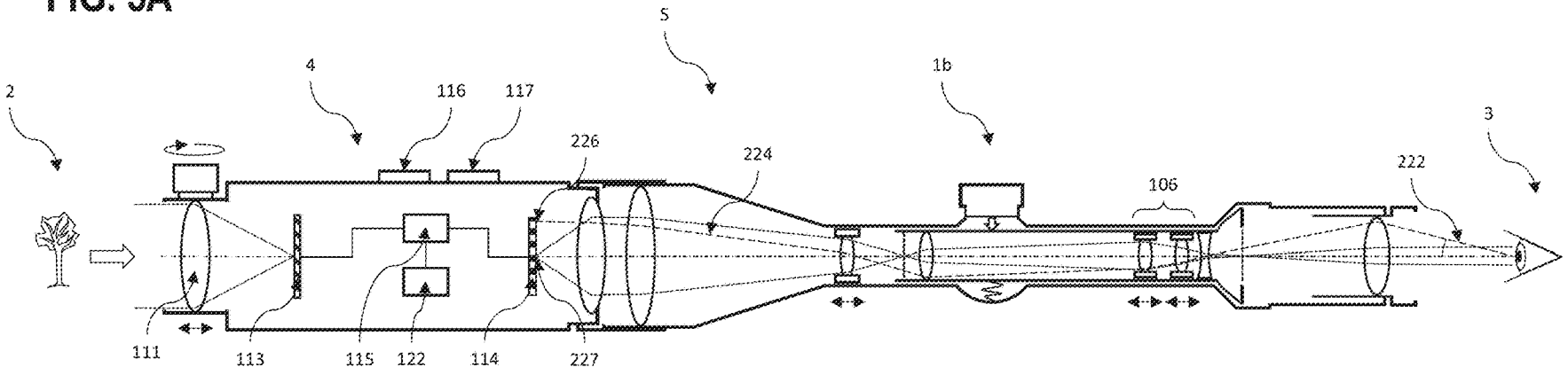
FIG. 5B shows a cross section through a sighting device including an attachment device and a telescopic sight with variable magnification in a second zoom setting.

FIGS. 5A and 5B show a further exemplary cross section through a telescopic sight 1*b* and a coupled attachment device 4, wherein the telescopic sight 1*b* is equipped with a zoom system 106 in this example. In terms of its properties, the attachment device 4 corresponds to those of the attachment device explained in relation to FIG. 4. In this case, FIG. 5A shows a first zoom setting of the zoom system 106 of the telescopic sight 1*b*; FIG. 5B shows a second zoom setting of the zoom system 106 of the telescopic sight 1*b*. The different zoom settings are identifiable on the basis of the different positions of the optical components of the zoom system 106.

A first outermost light ray 221 can be observed by the observer 3 in the first zoom setting from FIG. 5A. This light ray is created at a first pixel position 225 on the attachment device display 114 as a first emitted light ray 223. On the eyepiece side, the light of the first emitted light ray 223 takes an identical path to the first outermost light ray 221. A second outermost light ray 222 can be observed by the observer 3 in the second zoom setting from FIG. 5B. This light ray is created at a second pixel position 226 on the attachment device display 114 as second emitted light ray 224. On the eyepiece side, the light of the second emitted light ray 224 takes an identical path to the second outermost light ray 222. It is clearly visible that the light of the outermost light rays 221, 222 takes the same path on the eyepiece side, and hence on the observer side, i.e., it comes from the same field angle; however, in the examples, this relates to light rays with different origins on the attachment device display 114, specifically starting at pixel positions 225, 226. The first pixel position 225 is closer to a center 227 of the attachment device display 114 than the second pixel position 226 since FIG. 5A shows a zoom setting of the zoom system 106 with a higher magnification than FIG. 5B. In this case, the center 227 of the attachment device display 114 is considered to be the location on the attachment device display 114 which is located in the center of the region that is observable through the attachment device eyepiece 112 and the telescopic sight 1*b*.

An observer 3 is now able to observe all pixels of the attachment device display 114 in FIG. 5B whose distance from the center 227 of the attachment device display 114 is smaller than the distance of the pixel position 226 from said center.

Analogously, the pixels of the attachment device display 114 in FIG. 5A located radially outside of the pixel position 225 are not observable by the observer 3 as a matter of principle, on account of the high magnification of the zoom system 106 in that case. In other words, only a smaller portion of the attachment device display 114 is observable in the case of a high magnification of the telescopic sight 1*b*, when compared with a lower magnification.

This is made clear by the illustrations in FIG. 6. For two zoom settings of the telescopic sight 1*b*, FIG. 6 schematically shows which portion of the display area of the attachment device display 114 is observable through the telescopic sight 1*b* in the respective zoom setting. FIG. 6 I shows the situation for a weak magnification of the telescopic sight 1*b*: a subjective field of view 121 of the telescopic sight 1*b* captures a relatively large region of a display area 123 of the attachment device display 114, and so the indicators 310 at a first position close to the edge of the display area are observable through the telescopic sight 1*b*. FIG. 6 II shows the situation for a larger magnification of the telescopic sight 1*b*: the subjective field of view 121 of the telescopic sight 1*b* in this case captures a relatively smaller region of the display area 123 of the attachment device display 114, and so the indicators 310 at the first position 311 close to the edge of the display area are not observable through the telescopic sight 1*b*. If the indicators are displayed at a second, further inward position 312, they may be located within the subjective field of view 121 of the telescopic sight 1*b* and can be observable again.

The method according to an aspect of the disclosure is started by controlling a control element 116, 117 of the attachment device. The telescopic sight 1*b* should be in the zoom setting for which the display structures of the attachment device should be set. The data processing unit 115 of the attachment device 4 switches into the first step of the method according to an aspect of the disclosure and displays a center marking 301*a*, 301*b*, 301*c*, 301*d*, 301*e*, and 301*f* on the attachment device display 114. The center marking 301*a*, 301*b*, 301*c*, 301*d*, 301*e*, and 301*f* can be one of those shown in FIG. 7 in exemplary fashion and/or one from the following selection: a point, a circle, a star, a cross, and cross hairs or a comparable marking. FIG. 7A shows six possible exemplary embodiments of the center marking 301*a*, 301*b*, 301*c*, 301*d*, 301*e*, and 301*f* by way of example. The center marking 301*a*, 301*b*, 301*c*, 301*d*, 301*e*, and 301*f* is suitable for rendering a center position 301 identifiable to a user. In other words, any electronic-visual-display display suitable for marking a such a center position, referred to as 301, on an electronic visual display such that the position and/or its immediate surroundings is rendered identifiable by an observer of the electronic visual display is possible as such a center marking 301*a*, 301*b*, 301*c*, 301*d*, 301*e*, and 301*f*.

The data processing unit 115 of the attachment device 4 switches into a first interaction mode. In the process, the data processing unit 115 awaits an operation of the control elements 116, 117 and carries out an appropriate action post operation. Such an action can be the following:

- displacing the center position 301 of the center marking 301*a*, 301*b*, 301*c*, 301*d*, 301*e*, and 301*f* in a first direction and displaying the center marking 301*a*, 301*b*, 301*c*, 301*d*, 301*e*, and 301*f* at a new center position 303,
- displacing the center position 301 of the center marking 301*a*, 301*b*, 301*c*, 301*d*, 301*e*, and 301*f* in a direction opposite to the first direction and displaying the center marking 301*a*, 301*b*, 301*c*, 301*d*, 301*e*, and 301*f* at a new center position 303
- displacing the center position 301 of the center marking 301*a*, 301*b*, 301*c*, 301*d*, 301*e*, and 301*f* in a second direction and displaying the center marking 301*a*, 301*b*, 301*c*, 301*d*, 301*e*, and 301*f* at a new center position 303, displacing the center position 301 of the center marking 301*a*, 301*b*, 301*c*, 301*d*, 301*e*, and 301*f* in a direction opposite to the second direction and displaying the center marking 301*a*, 301*b*, 301*c*, 301*d*, 301*e*, and 301*f* at the new center position 303, and terminating the first interaction mode It is understood that, for the next interaction step, the new center position 303 should be considered to be the center position 301 for a next step, and so a multi-stage displacement of the center position 301 is made possible, regardless of direction. In other words, the center position 301 can be displaced incrementally by multiple applications of one or more of the aforementioned steps, wherein the new center position 303 simultaneously forms the start position of the center position 301 for a next step.

Figure 7B:
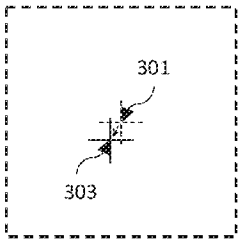
FIG. 7B shows an example for the center marking shift.
Figure 7A:
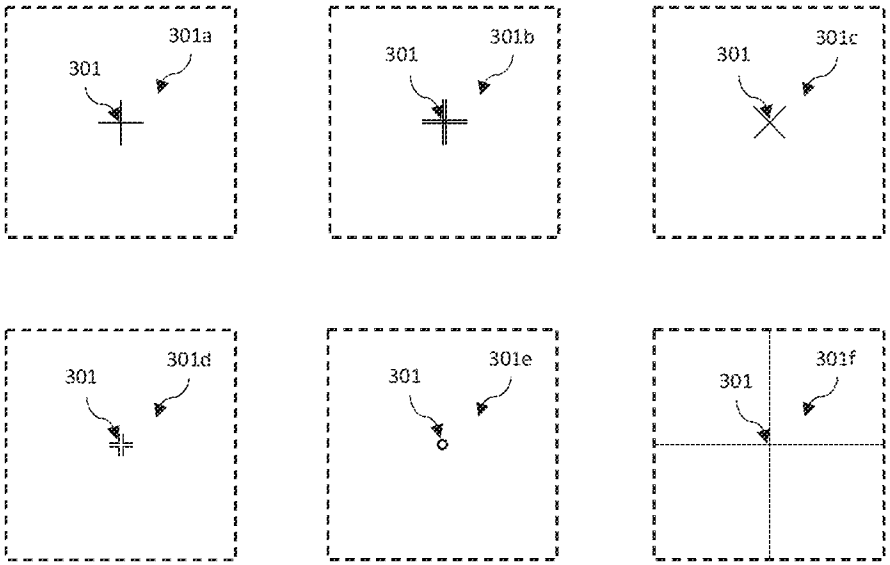
FIG. 7A shows examples of center markings.

The displacement of the center position 301 to the new center position 303 is depicted schematically in FIG. 7B.

According to an aspect of the disclosure, the first interaction mode can also be terminated by virtue of the data processing unit 115 terminating it independently after a predetermined time period without an operation of a control element 116, 117 has elapsed.

A further action of the data processing unit 115 can be to switch between, typically also switch back and forth between, the first displacement direction and the second displacement direction such that the displacement in the first direction and in the second direction can be implemented by the operation of the same control element 116, 117, depending on the displacement direction currently set.

After the first interaction mode was terminated by the data processing unit 115, the value of the center position 301, 303 of the center marking 301*a*, 301*b*, 301*c*, 301*d*, 301*e*, and 301*f* is stored in a non-transitory memory 122. This non-transitory memory 122 can be part of the data processing unit 115 or can be electronically connected to the data processing unit 115.

Figure 8:
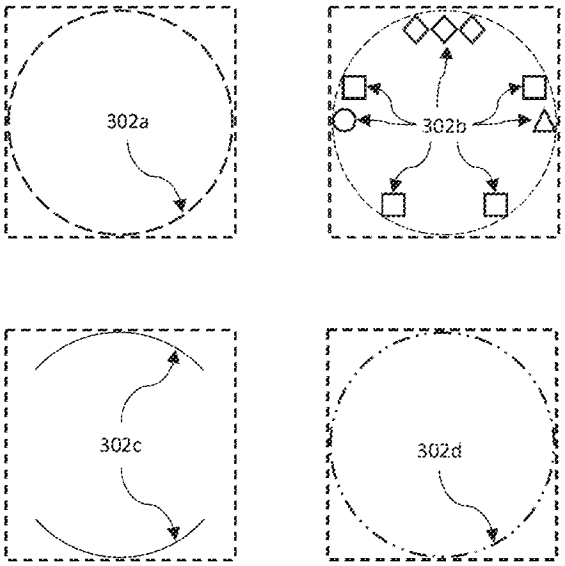
FIG. 8 shows examples of circular markings.

After the first step of the method according to an aspect of the disclosure has been terminated, the data processing unit 115 of the attachment device 4 switches, according to an aspect of the disclosure, into the second step of the method according to an aspect of to the disclosure and displays a circular marking 302*a*, 302*b*, 302*c*, and 302*d* on the attachment device display 114. According to an aspect of the disclosure, the circular marking 302*a*, 302*b*, 302*c*, and 302*d* is displayed in such a way that it is centered around the last center position 301, 303 of the center marking 301*a*, 301*b*, 301*c*, 301*d*, 301*e*, and 301*f*. According to an aspect of the disclosure, the display of the center marking 301*a*, 301*b*, 301*c*, 301*d*, 301*e*, and 301*f* can be activated or else deactivated in this step. The circular marking 302*a*, 302*b*, 302*c*, and 302*d* can be one of those shown in FIG. 8 in exemplary fashion and/or, by way of example, one of the following selection: a solid circle, a circle portion, a regularly or irregularly dashed circle, a regularly or irregularly dotted circle consisting of at least three points. FIG. 8 illustrates examples to this end: a circular marking as a dashed circle (top left), a circular marking made of two circle portions (bottom left), a circular marking made of geometric figures and numbers arranged on a circular line (top right), a circular marking made of a dotted/dashed line (bottom right). The data processing unit 115 of the attachment device 4 switches into a second interaction mode. In the process, the data processing unit 115 awaits an operation of the control elements 116, 117 and carries out an appropriate action post operation. Such an action can be the following:

increasing the size of the radius of the circular marking 302*a*, 302*b*, 302*c*, and 302*d* in two dimensions and displaying the circular marking 302*a*, 302*b*, 302*c*, and 302*d* in the new size, decreasing the size of the radius of the circular marking 302*a*, 302*b*, 302*c*, and 302*d* in two dimensions and displaying the circular marking 302*a*, 302*b*, 302*c*, and 302*d* in the new size, increasing the size of the radius of the circular marking 302*a*, 302*b*, 302*c*, and 302*d* in a first dimension and displaying the circular marking 302*a*, 302*b*, 302*c*, and 302*d* in the new size, reducing the size of the radius of the circular marking 302*a*, 302*b*, 302*c*, and 302*d* in a first dimension and displaying the circular marking 302*a*, 302*b*, 302*c*, and 302*d* in the new size, increasing the size of the radius of the circular marking 302*a*, 302*b*, 302*c*, and 302*d* in a second dimension and displaying the circular marking 302*a*, 302*b*, 302*c*, and 302*d* in the new size, decreasing the size of the radius of the circular marking 302*a*, 302*b*, 302*c*, and 302*d* in a second dimension and displaying the circular marking 302*a*, 302*b*, 302*c*, and 302*d* in the new size, changing the radius of the circular marking 302*a*, 302*b*, 302*c*, and 302*d* to a new size from a discrete list of defined sizes, stored in the data processing unit 115, and displaying the circular marking 302*a*, 302*b*, 302*c*, and 302*d* in the new size, and terminating the second interaction mode.

According to an aspect of the disclosure, the second interaction mode can likewise be terminated by virtue of the data processing unit 115 terminating it independently after a predetermined time period without an operation of a control element 116, 117 has elapsed.

A further action of the data processing unit 115 can be to switch between, typically also switch back and forth between, the first dimension of the change and the second dimension of the change such that the change in the size in the first dimension and in the second dimension can be implemented by the operation of the same control element 116, 117, depending on the direction currently set.

After the second interaction mode was terminated by the data processing unit 115, the values or value of the size of the circular marking 302*a*, 302*b*, 302*c*, and 302*d* is stored in the non-transitory computer-readable storage medium 122. The non-transitory computer-readable storage medium 122 can be part of the data processing unit 115 or can be electronically connected to the data processing unit 115.

Typically, the display of information on the attachment device display 114 is set by the attachment device 4 directly after the termination of the second step according to an aspect of the disclosure, in such a way that such information displayed is now displayed only within a region of the attachment device display 114 located within the radius of the size of the circular marking 302*a*, 302*b*, 302*c*, and 302*d* chosen in the second step.

Optionally, the termination of the second step can be followed by a third step according to an aspect of the disclosure, in which the data processing unit 115 switches into a third interaction mode. In this interaction mode, the data processing unit 115 awaits the operation of the control elements 116, 117 for defining a profile memory location in the non-transitory memory 122. A menu and/or similar information optionally required to select the profile memory location is typically displayed on a region of the attachment device display 114 located within the radius of the circular marking 302*a*, 302*b*, 302*c*, and 302*d* selected in the second step. This can ensure that the required pieces of information and/or menus are observable in the current setting of the magnification of the telescopic sight 1*b*.

Just like the first two steps, the third step is terminated, according to an aspect of the disclosure, either by operating a control element 116, 117 and/or automatically after the expiry of a predetermined time interval without interaction by the user. In particular, according to an aspect of the disclosure, the choice of a profile memory location from a plurality of profile memory locations offered to the user made by the operation of a control element 116, 117 can lead to the termination of the third step, and hence the termination of the third interaction mode, after the profile data, in particular the data regarding the center position 301, 303 of the center marking 301*a*, 301*b*, 301*c*, 301*d*, 301*e*, and 301*f* and the size of the circular marking 302*a*, 302*b*, 302*c*, and 302*d*, are stored in the selected profile memory location in the non-transitory computer-readable storage medium 122.

When the sighting device 5 is used, for example within hunting, provision can be made for a user to select a profile memory location by operating one or more control elements 116, 117, whereupon the attachment device 4 switches into a display mode such that the further display of information and/or menus and/or icons and/or symbols is only still implemented within the radius, stored in the chosen profile memory location, around the center, stored in the chosen profile memory location.

Figure 5C:
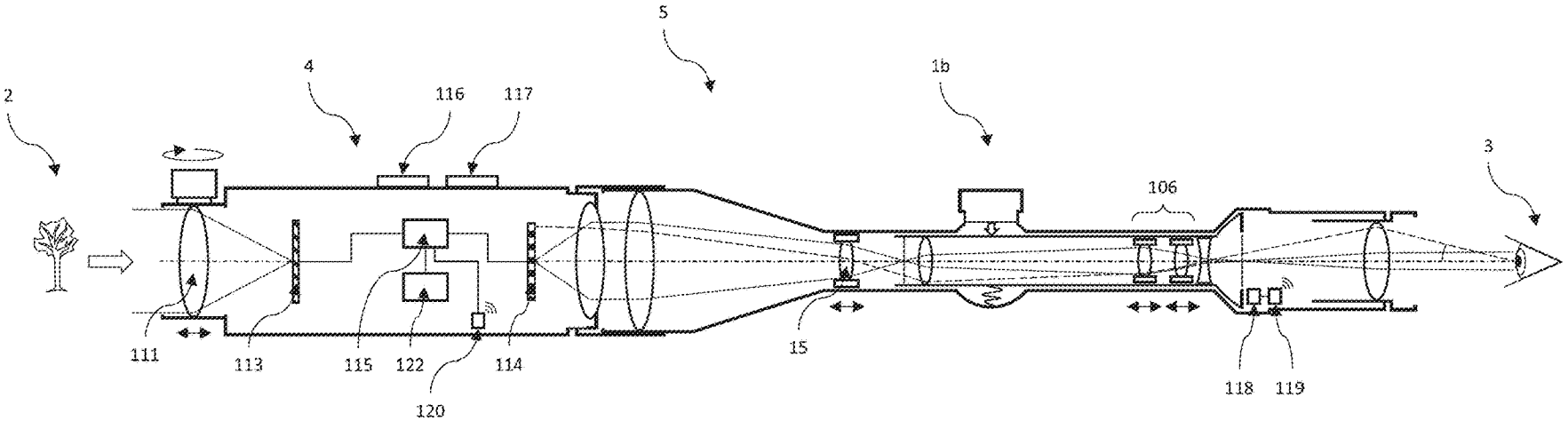
FIG. 5C shows a cross section through a sighting device with wireless communication.

As a further exemplary embodiment, FIG. 5C shows the sighting device 5, as shown in FIGS. 5A and 5B, in the zoom setting of FIG. 5B, wherein this sighting device 5 is equipped with a zoom sensor 118 for detecting the zoom setting or magnification of the telescopic sight with variable magnification 1*b*, in addition to the features of the exemplary embodiments above. The zoom sensor might contain a controller which converts the physical measurement value into digital or similar zoom information. For example, this zoom information can be information regarding the magnification of the telescopic sight 1*b*, but for example also information regarding the imaging scale of the optical group provided for the zoom. Moreover, the sighting device 5 includes wireless communication means for exchanging data between the telescopic sight 1*b* and the attachment device 4. The wireless communication means include at least one first radio unit 119 on or in the telescopic sight 1*b* and at least one second radio unit 120 on or in the attachment device 4. The first radio unit 119 and the second radio unit 120 can each be formed as a transmitter and/or as a receiver. Particularly typically, both the first radio unit 119 and the second radio unit 120 have both transmission and reception capabilities, with the result that bidirectional communication is rendered possible. It is however also conceivable that only one of the units 119, 120 is a transmitter and the respective other unit is a receiver, with the result that unidirectional communication is possible. To ensure full functionality, a second pair of radio units 119, 120 is also used in this case; they have opposite roles in relation to the first pair and allow unidirectional communication in the other direction. The first radio unit 119 and the second radio unit 120 can exchange digital signals, for example by Bluetooth or WLAN or with any other comparable technology for wireless data transfer. The zoom sensor 118 detects the magnification set on the telescopic sight by the user 3 and converts this into digital zoom information. This digital zoom information can be transmitted wirelessly to the second radio unit 120 by the first radio unit 119. Such a transmission can take place both during the implementation of the method according to an aspect of the disclosure and during the use of the sighting device (for hunting). To query the zoom setting, the attachment device 4 can transmit a trigger signal to the telescopic sight 1*b* via the wireless communication means, second radio unit 120 and first radio unit 119. Prompted by this trigger signal, the zoom sensor 118 determines the magnification or zoom setting that is set on the telescopic sight 1*b*. The zoom information regarding the set magnification determined thus is then transferred to the attachment device 4 via the wireless communication means, the first radio unit 119 and the second radio unit 120. The zoom information regarding the set magnification or zoom setting can be stored in a profile memory location of the attachment device 4, in order to be used in the manner described for the optimal adjustment of the displayed display during a subsequent use of the telescopic sight 1*b*.

LIST OF REFERENCE NUMERALS

1 Telescopic sight
1*a* Telescopic sight with fixed magnification
1*b* Telescopic sight with variable magnification
2 Object
3 Observer
4 Attachment device
5 Sighting device
10 Outer tube
10*b* Separate tube portion
11 Inner tube
12 Reticle adjustment
13 Focus adjustment
14 Reticle
15 Focusing lens
101 Telescopic sight objective lens
102 Telescopic sight eyepiece
103 Field lens
104 Erecting system
105 Further lens group of the erecting system
106 Zoom system
108 Spring
109 Barlow lens
111 Attachment device objective lens
112 Attachment device eyepiece
113 Attachment device sensor
114 Attachment device display
115 Data processing unit
116, 117 Control element
118 Zoom sensor
119 First radio unit
120 Second radio unit
121 Subjective field of view
122 Non-transitory computer-readable storage medium
123 Display area
201 First image plane
202 Second image plane
221 First outermost light ray
222 Second outermost light ray
223 First emitted light ray
224 Second emitted light ray
225 First pixel position
226 Second pixel position
227 Center
30 Center position
301*a*, 301*b*, 301*c*, 301*d*, 301*c*, 301*f* Center marking
302*a*, 302*b*, 302*c*, 302*d* Display structures of the circular marking
303 New center position

310 Indicators
311 First position of the indicators
312 Second position of the indicators

What is claimed is:

1. A sighting device, comprising:

a zoomable telescopic sight; and an attachment device, the attachment device including an attachment device display, at least one control element, and a non-transitory computer-readable storage medium, the attachment device being connected to the zoomable telescopic sight such that the attachment device display can be observed through the zoomable telescopic sight, wherein the zoomable telescopic sight includes a zoom sensor configured to determine zoom information regarding the zoomable telescopic sight and a first radio unit, wherein the attachment device includes a second radio unit, and wherein the zoom sensor, the first radio unit, and the second radio unit are configured such that the zoom information can be transmitted wirelessly to the attachment device.

2. The sighting device according to claim 1, wherein the attachment device is a thermal imaging device or a residual light amplifier.

3. The sighting device according to claim 1, wherein at least one of the control elements of the attachment device is selected from the group consisting of a control button, a pushbutton, a switch, a rotary wheel, a joystick, and a touchpad.

4. The sighting device according to claim 1, wherein at least one of the control elements of the attachment device is formed by a digital terminal such that operation of the digital terminal transmits data to the attachment device via a wireless data connection.

5. The sighting device according to claim 4, wherein the digital terminal is a device selected from the group consisting of a cellular telephone, a tablet, a laptop, and a remote control.

6. The sighting device according to claim 1, wherein the sighting device is configured to:

display a center marking at a center position on the attachment device display and activate a first interaction mode, in which the center position of the center marking can be shifted into a new center position by operating at least one control element, display a circular marking and activate a second interaction mode, in which a size of the circular marking is changeable by operating at least one control element, and store display information regarding the new center position and the size of the circular marking in the non-transitory computer-readable storage medium.

7. The sighting device according to claim 6, wherein the circular marking is arranged in a manner centered around the center position of the center marking.

8. The sighting device according to claim 7, wherein the display information regarding the center position of the center marking and regarding the size of the circular marking is stored in a profile memory location in the non-transitory computer-readable storage medium.

9. A sighting device, comprising:

a zoomable telescopic sight; and an attachment device, the attachment device including an attachment device display, at least one control element, and a non-transitory computer-readable storage medium, the attachment device being connected to the zoomable telescopic sight such that the attachment device display can be observed through the zoomable telescopic sight, wherein the zoomable telescopic sight includes a zoom sensor configured to determine zoom information regarding the zoomable telescopic sight and an electrical interface arranged in a region of a mechanical interface between the zoomable telescopic sight and the attachment device, and wherein the zoom sensor and the electrical interface are configured such that the zoom information can be transmitted to the attachment device.

* * * * *